US012687348B2

(12) United States Patent
Potok et al.

(10) Patent No.: US 12,687,348 B2
(45) Date of Patent: Jul. 21, 2026

(54) HEAT EXCHANGER WITH CORROSION REDUCING SACRIFICIAL COMPONENT

(71) Applicant: Valeo Autosystemy Sp. z o.o., Skawina (PL)

(72) Inventors: Dariusz Potok, Skawina (PL); Agnieszka Bujas, Skawina (PL); Lukasz Bialo, Skawina (PL); Mateusz Lipowski, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 67 days.

(21) Appl. No.: 18/551,062

(22) PCT Filed: Feb. 23, 2022

(86) PCT No.: PCT/EP2022/054481
§ 371 (c)(1),
(2) Date: Sep. 18, 2023

(87) PCT Pub. No.: WO2022/194504
PCT Pub. Date: Sep. 22, 2022

(65) Prior Publication Data

US 2024/0159477 A1 May 16, 2024

(30) Foreign Application Priority Data

Mar. 17, 2021 (EP) ..... 21163035

(51) Int. Cl.
*F28F 9/00* (2006.01)
*F28D 7/16* (2006.01)
(Continued)

(52) U.S. Cl.
CPC ..... *F28F 9/001* (2013.01); *F28D 7/1684* (2013.01); *F28F 9/005* (2013.01);
(Continued)

(58) Field of Classification Search
CPC .. F28F 21/00; F28F 9/001; F28F 19/06; F01P 2011/066; C22C 21/00
See application file for complete search history.

(56) References Cited

U.S. PATENT DOCUMENTS 4,473,110 A 9/1984 Zawierucha
9,956,654 B2 5/2018 Kafuku et al.
(Continued)

FOREIGN PATENT DOCUMENTS

CN 105051481 A 11/2015
EP 3587991 A1 1/2020
(Continued)

OTHER PUBLICATIONS

Translation of JPH10246595A named Translation—JPH10246595A (Year: 1998).*
(Continued)

*Primary Examiner* — Paul Alvare
(74) *Attorney, Agent, or Firm* — Osha Bergman Watanabe & Burton LLP

(57) ABSTRACT

A heat exchanger for exchanging heat between a first fluid and a second fluid is disclosed in accordance with an embodiment of the present invention. The heat exchanger includes a first manifold, a second manifold, a bundle of heat exchange elements and a housing. The bundle of heat exchange elements for the first fluid axially extend and provide a fluidal communication between the manifolds. The housing for the second fluid encapsulates at least part of the heat exchange elements to form a fluid tight channel for the second fluid. The housing further includes at least one sacrificial component being of material having lower galvanic potential than the remaining components.

12 Claims, 6 Drawing Sheets

(51) Int. Cl.
*F28F 19/06* (2006.01)
*F28F 21/00* (2006.01)
*F01P 11/06* (2006.01)

(52) U.S. Cl.
CPC ..... *F01P 2011/066* (2013.01); *F28F 19/06* (2013.01); *F28F 21/00* (2013.01)

(56) References Cited

U.S. PATENT DOCUMENTS

2002/0005278 A1* 1/2002 Ozaki ..... F28D 1/0435 204/196.01
2005/0230089 A1* 10/2005 Ozaki ..... F28F 9/001 165/149
2006/0086486 A1* 4/2006 Sudo ..... F28D 1/05391 62/515
2006/0283580 A1* 12/2006 Usui ..... C23C 28/322 29/890.03
2007/0039722 A1* 2/2007 Angermann ..... F28D 7/1653 165/158
2008/0190403 A1* 8/2008 Grunenwald ..... F02B 29/0462 123/568.12
2008/0223562 A1* 9/2008 Braic ..... F28F 9/0224 165/158
2010/0089548 A1* 4/2010 Braic ..... F28D 7/1692 165/72
2011/0247318 A1* 10/2011 Kuroyanagi ..... F28F 9/001 60/278
2011/0247320 A1* 10/2011 Ruckwied ..... F28D 7/1684 60/309
2019/0063849 A1* 2/2019 McDonnell ..... F28D 9/0006
2021/0148651 A1* 5/2021 Kubo ..... F28F 9/00

FOREIGN PATENT DOCUMENTS

JP H10246595 A * 9/1998
JP 2014145571 A 8/2014
JP 2018131908 A * 8/2018

OTHER PUBLICATIONS

Translation of JP2018131908A named Translation—JP2018131908A (Year: 2018).*
European Patent Office, International Search Report and Written Opinion of corresponding International Application No. PCT/EP2022/054481, dated Apr. 22, 2022.
Office Action issued by the Chinese Intellectual Property Office for corresponding Chinese patent application No. 202280021573.5, mailed Mar. 11, 2026 (6 pages).

* cited by examiner

HEAT EXCHANGER WITH CORROSION REDUCING SACRIFICIAL COMPONENT

TECHNICAL FIELD

The present invention relates to a heat exchanger, more particularly, the present invention relates to a heat exchanger used in a corrosive environment.

BACKGROUND OF THE INVENTION

Generally, the heat exchangers are exposed to detrimental environment conditions. The heat exchangers mounted on a vehicle are particularly subjected to diverse environment conditions as the vehicle travels in regions with different climatic conditions. The heat exchangers mounted on the vehicle are exposed to products of condensation of atmospheric water vapor that can be acidic and hence corrosive in nature. Such exposure to acidic products of condensation or any other corrosive environment can damage the brazing joint between the components of the heat exchanger joined by brazing and is detrimental for the fluid tightness of cooling/heating circuit of the heat exchanger. Particularly, such damage to the brazing joints between the components causes leakage of heat exchange fluid flowing though the cooling/heating circuit, thereby detrimentally affecting the efficiency and performance of the heat exchanger. The loose brazing joint can between components can cause rattling noise and other Noise Vibration and Harshness (NVH) issues. Further, such corrosive environment also causes depletion of dimension of the components of the heat exchanger. In case the corrosive environment causes depletion of dimension of critical components of the heat exchanger such as the housing or the heat exchange tubes and causes internal pitting and cracks, there are chances of leakage of heat exchange fluid through the corroded elements, thereby detrimentally affecting the efficiency and performance of the heat exchanger. In case the heat exchanger fails to efficiently perform it's function, the efficiency and performance of the elements supplied with the heat exchange fluid by the heat exchanger is also detrimentally affected. For example, in case the heat exchanger is a Water Charge Air Cooler, hereinafter referred to as WCAC, the inefficient performance of the WCAC causes insufficient cooling of the air thereby as compared to when the air is cooled by efficiently operating WCAC. The insufficiently cooled air supplied to the engine by inefficiently operating WCAC is ineffective in improving efficiency and performance of the engine, thereby limiting the advantages of configuring the engine with the WCAC. The corrosion can also lead to mechanical failure, frequent maintenance and replacement of critical components of the heat exchanger, thereby reducing the service life of the heat exchanger and increasing the maintenance costs.

Although, the harmful effects of corrosion of the critical elements of the heat exchanger can be reduced by increasing the thickness of the critical components of the heat exchanger, however, increasing the thickness of the sections of the heat exchanger components also increases the overall dimension and weight of the heat exchanger. The increase in dimension of the heat exchanger causes packaging issues and increase in overall weight of the vehicle reduces the fuel efficiency of the vehicle.

Accordingly, there is a need for a heat exchanger that prevents corrosion of critical elements of the heat exchanger and prevents problems caused by the corrosion of critical elements of the heat exchanger without increasing the overall weight and dimension thereof. More specifically, there is a need for a heat exchanger that prevents cracks and pitting of the critical components of the heat exchanger, thereby increasing service life of the heat exchanger and reducing downtime, maintenance and maintenance costs, replacement costs. Furthermore, there is a need for a heat exchanger that is simple in construction and convenient to manufacture and does not involve complex manufacturing/production processes for enhancing corrosion resistance of the heat exchanger and rendering the heat exchanger robust and resistant to adverse environment conditions.

BRIEF SUMMARY OF THE INVENTION

An object of the present invention is to provide a heat exchanger that prevents corrosion of critical elements of the heat exchanger and prevents problems caused by the corrosion of critical elements of the heat exchanger without increasing the overall weight and dimension thereof.

Another object of the present invention is to provide a heat exchanger that prevents cracks and pitting of the critical components of the heat exchanger, thereby increasing service life of the heat exchanger and reducing downtime, maintenance and maintenance costs, replacement costs.

Yet another object of the present invention is to provide a heat exchanger that is simple in construction, convenient to manufacture and does not involve complex manufacturing/production processes for enhancing corrosion resistance of the heat exchanger and rendering the heat exchanger robust and resistant to adverse environment conditions.

In the present description, some elements or parameters can be indexed, such as a first element and a second element. In this case, unless stated otherwise, this indexation is only meant to differentiate and name elements which are similar but not identical. No idea of priority should be inferred from such indexation, as these terms can be switched without betraying the invention. Additionally, this indexation does not imply any order in mounting or use of the elements of the invention.

A heat exchanger for exchanging heat between a first fluid and a second fluid is disclosed in accordance with an embodiment of the present invention. The heat exchanger includes a first manifold, a second manifold, a bundle of heat exchange elements and a housing. The bundle of heat exchange elements for the first fluid axially extend and provide a fluidal communication between the manifolds. The housing for the second fluid encapsulates at least part of the heat exchange elements to form a fluid tight channel for the second fluid. The housing further includes at least one sacrificial component being of material having lower galvanic potential than the remaining components.

Generally, the sacrificial component is part of the housing.

Particularly, the sacrificial component is attached to the housing.

More specifically, the sacrificial component is attached directly to at least one heat exchange element.

Particularly, the heat exchange elements are flat tubes and the sacrificial component is parallel to and in contact with the flat surface of at least one terminal heat exchange element of the bundle.

Further, at least one of the manifolds includes a collar at least partially overlapping the bundle of heat exchange elements in assembled configuration of the heat exchanger.

In accordance with an embodiment of the present invention, the sacrificial component is fixed between the bundle of heat exchange elements and the collar.

Particularly, the sacrificial component includes at least one recessed section extending from a median section of the shorter side thereof.

Further, the sacrificial component includes at least a pair of projections located on opposite ends of the shorter side thereof.

Specifically, at least one of the projections includes a sloping portion configured to facilitate fixing the sacrificial component between the bundle of heat exchange elements and the collar.

Preferably, the sacrificial component is an auxiliary plate that includes at least one opening, so that opening partially uncovers the surface of at least one heat exchange element.

Particularly, the auxiliary plate includes four openings, wherein the openings are located symmetrically with respect to axis of symmetry of the auxiliary plate, so that a first median bar and a second median bar are created, wherein the median bars intersect each other perpendicularly in the middle of the auxiliary plate.

Generally, the at least one plate defining the housing is of Al—Zn alloy.

Particularly, the plate is of Al—Zn alloy and the proportion of zinc in the Al—Zn alloy is in the range of 1 to 2 percent.

More particularly, the plate is of Al—Zn alloy and the proportion of zinc in the Al—Zn alloy is 1.5 percent.

BRIEF DESCRIPTION OF THE DRAWINGS

Other characteristics, details and advantages of the invention can be inferred from the description of the invention hereunder. A more complete appreciation of the invention and many of the attendant advantages thereof will be readily obtained as the same becomes better understood by reference to the following detailed description when considered in connection with the accompanying figures, wherein.

DETAILED DESCRIPTION OF THE INVENTION

It must be noted that the figures disclose the invention in a detailed enough way to be implemented, said figures helping to better define the invention if needs be. The invention should however not be limited to the embodiment disclosed in the description.

Although the present invention is described with example of heat exchanger used in vehicular environment, wherein the heat exchanger is formed with a sacrificial component that undergoes corrosion to prevent corrosion of the other critical components of the heat exchanger. The heat exchanger of such configuration, particularly, the heat exchanger with sacrificial components is capable of preventing problems arising due to corrosion of the critical components of the heat exchanger and the heat exchanger exhibits improved service life and involves reduced maintenance compared to the conventional heat exchangers. However, the present invention is also applicable for heat exchangers that are used in non-vehicular environments. Further, the present invention is also applicable to other critical equipment that are subjected to corrosive environments and are prone to damage, frequent maintenance and replacement due to exposure to such corrosive environments.

Figure 1:
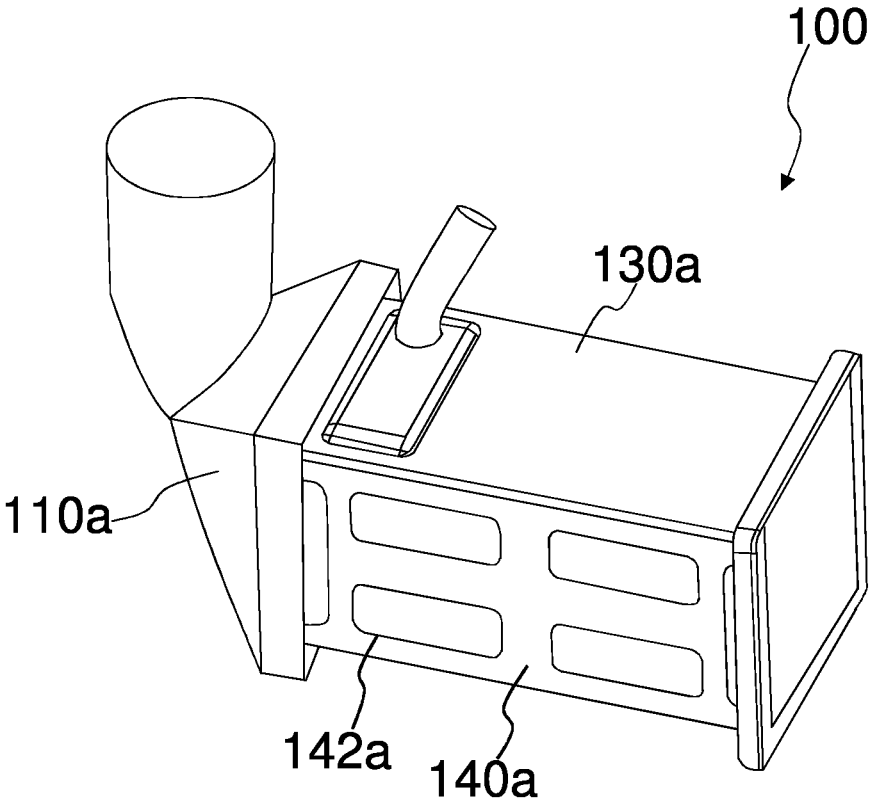
FIG. 1 illustrates an isometric view of a heat exchanger in accordance with an embodiment of the present invention, in the FIG. 1 the heat exchanger is depicted with one manifold of the pair of manifolds.
Figure 2:
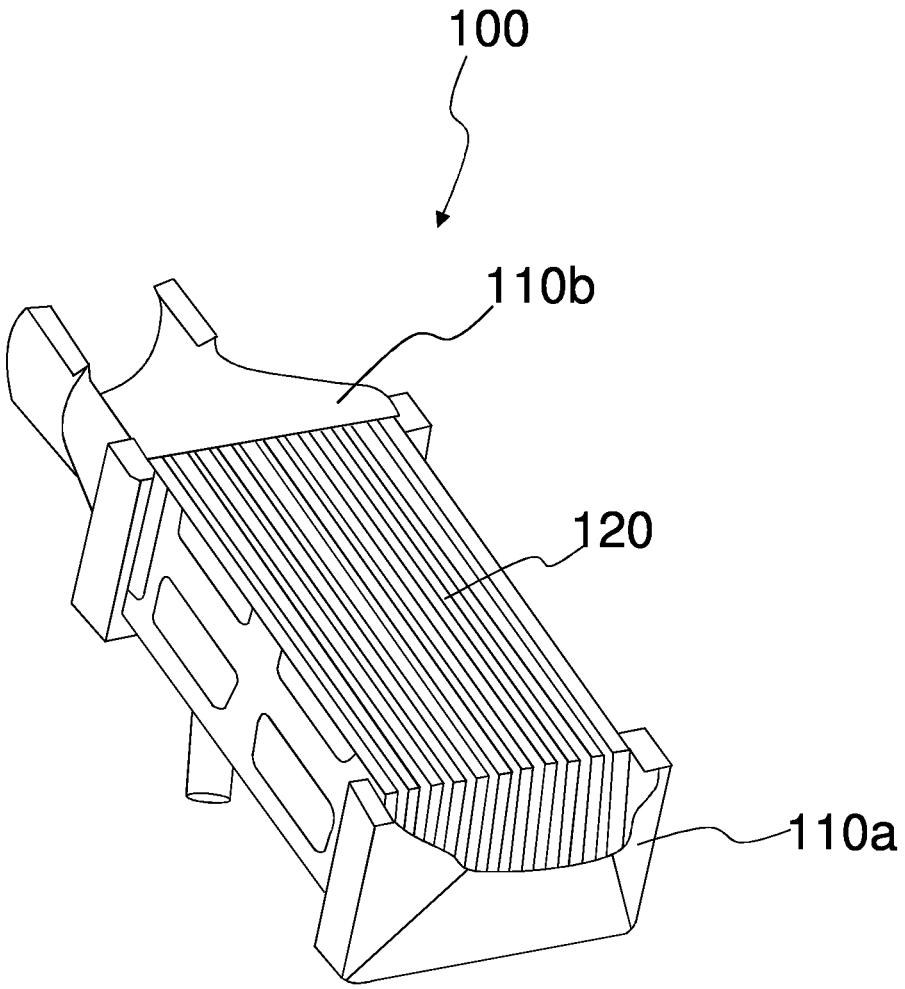
FIG. 2 illustrates a sectional view of the heat exchanger depicting internal details thereof.
Figure 3:
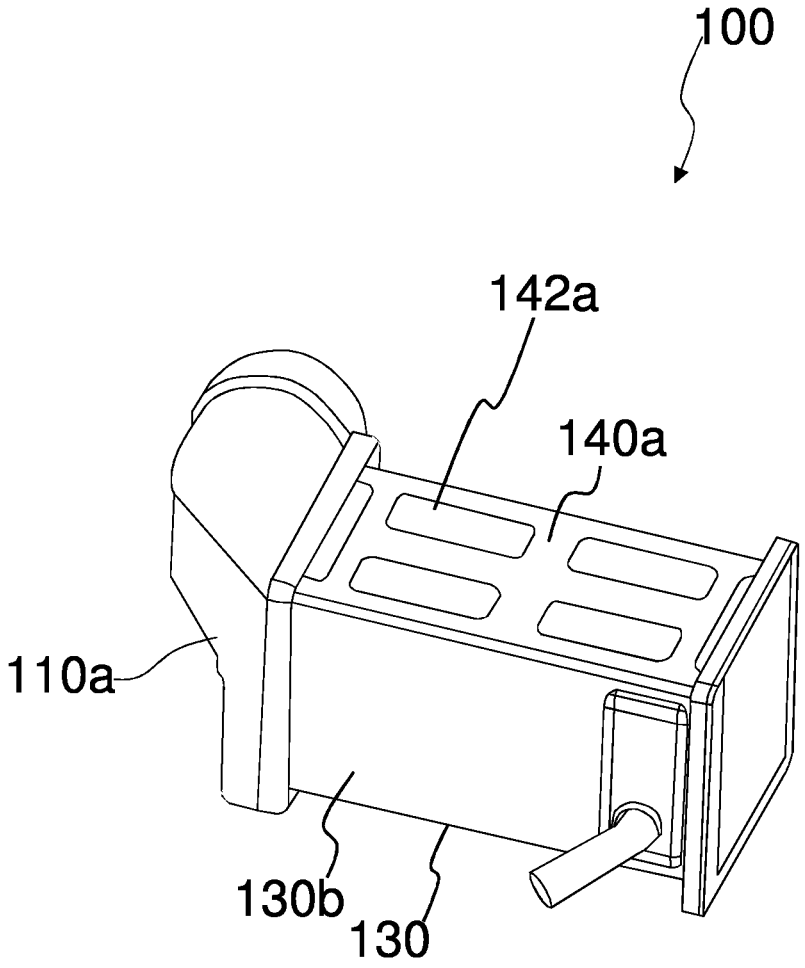
FIG. 3 illustrates another isometric view of the heat exchanger of FIG. 1.
Figure 4:
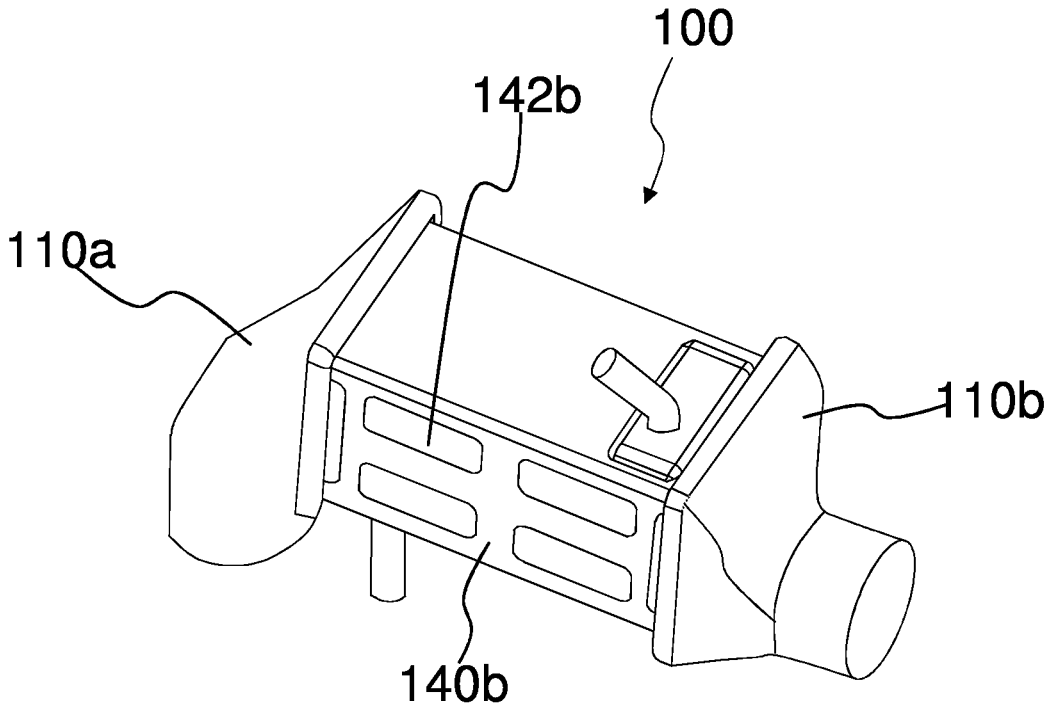
FIG. 4 illustrated an isometric view of the heat exchanger depicting both the manifolds.
Figure 5:
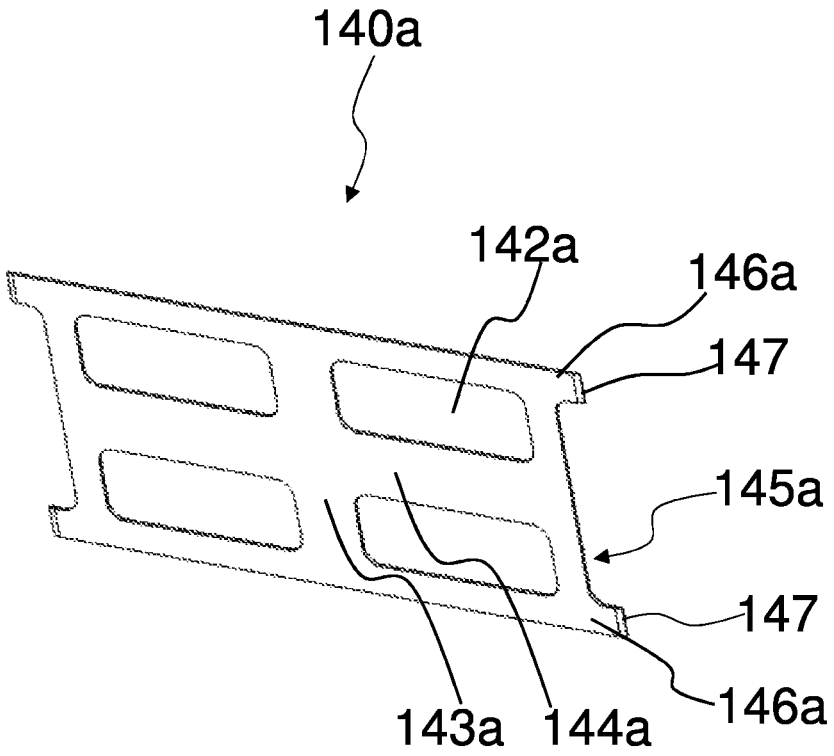
FIG. 5 illustrates an isometric view of a sacrificial component of the heat exchanger of FIG. 1, wherein the sacrificial component is an auxiliary plate.
Figure 6:
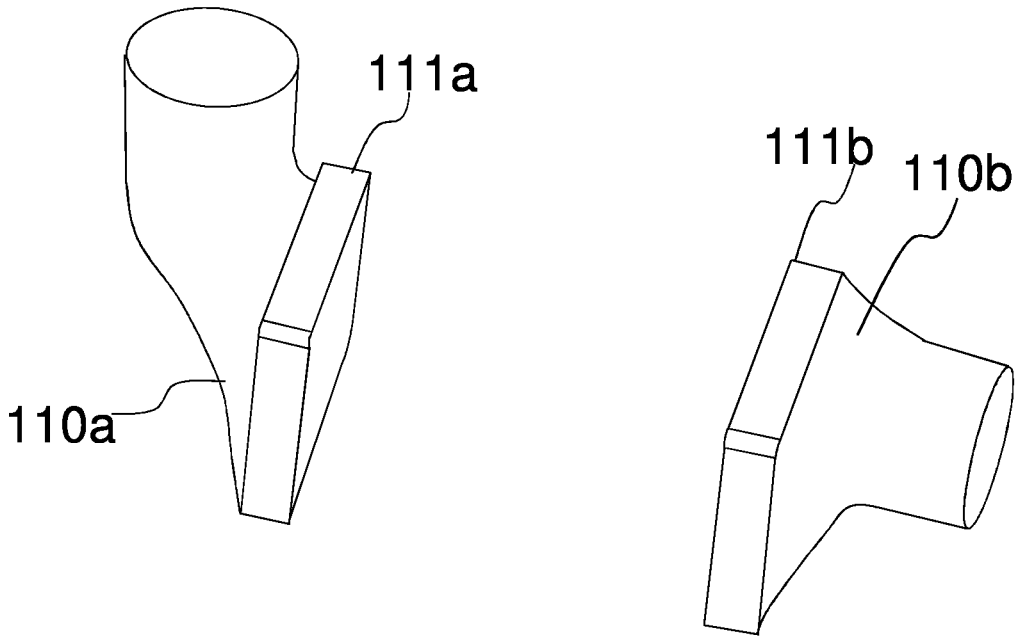
FIG. 6 illustrates an isometric view of the manifolds of the heat exchanger of FIG. 4.

FIG. 1 illustrates an isometric view of a heat exchanger 100 in accordance with an embodiment of the present invention. The heat exchanger 100 includes a first manifold 110*a*, a second manifold 110*b*, a bundle of heat exchange elements 120 and a housing 130. The heat exchanger 100 further includes at least one sacrificial component. In the FIG. 1, the heat exchanger 100 is depicted with one manifold of the pair of manifolds 110*a* and 110*b*. FIG. 2 illustrates a sectional view of the heat exchanger 100 depicting internal details thereof. FIG. 3 illustrates another isometric view of the heat exchanger 100. FIG. 4 illustrated an isometric view of the heat exchanger 100 depicting both the manifolds 110*a* and 110*b*. FIG. 5 illustrates an isometric view of the sacrificial component of the heat exchanger, wherein the sacrificial component is an auxiliary plate. FIG. 6 illustrates an isometric view of the manifolds of the heat exchanger 100.

Referring to the FIG. 2 of the accompanying drawing, the bundle of heat exchange elements 120 for the first fluid axially extend and provide a fluidal communication between the manifolds 110*a* and 110*b*. In accordance with one embodiment, the heat exchange elements 120 are tubes connecting the first manifold 110*a* and the second manifold 110*b* and are in fluid communication with the first manifold 110*a* and the second manifold 110*b*. Specifically, the heat exchange tubes 120 configure fluidal communication between the first manifold 110*a* and the second manifold 110*b*. The first heat exchange fluid flows from the first manifold 110*a* to the second manifold 110*b* through the heat exchange tubes, in the process exchanging heat with a second heat exchange fluid flowing around the heat exchange tubes and across the heat exchange tubes. In accordance with another embodiment of the present invention, the heat exchange elements 120 are plates that configure fluid flow passages between a first set of adjacent plates to configure fluidal communication between the first manifold 110*a* and the second manifold 110*b*. The first heat exchange fluid flows from the first manifold 110*a* to the second manifold 110*b* through the flow passages defined between the first set of adjacent plates, in the process exchanging heat with a second heat exchange fluid flowing across a second set of adjacent plates.

Referring to the FIGS. 1, 2, 3 and 4 of the accompanying drawings, the housing 130 for receiving the second fluid encapsulating at least part of the heat exchange elements 120 to form a fluid tight channel for the second fluid is illustrated. The housing 130 includes an inlet and an outlet. The inlet is in fluid communication with the fluid tight channel for ingress of the second fluid in the fluid tight channel. The outlet is in fluid communication with the fluid tight channel for egress of the second fluid from the fluid tight channel. In one embodiment of the present invention, the housing 130 includes a top plate 130*a*, a bottom plate 130*b* and a pair of side plates interconnecting the top plate 130*a* and the bottom plate 130*b*, which can be referenced to as housing plates. The open ends of the housing 130 are closed by the first and the second manifolds 110*a* and 110*b* respectively to define the enclosure. In accordance with another embodiment of the present invention, the housing 130 includes the top plate 130*a*, the bottom plate 130*b* and the terminal heat exchange elements act as the side plates. The terminal heat exchange elements are the heat exchange elements disposed at the terminal sides of the bundle of heat exchange elements that are either one of flat heat exchange tube or heat exchange plates. In case, the terminal heat exchange elements act as the side plates, the first and the second manifolds 110*a* and 110*b* close the ends of the housing 130.

The sacrificial component of the heat exchanger 100 undergoes corrosion to reduce the effect of corrosive environments on the critical components of the heat exchanger 100. More specifically, the sacrificial component is of material having lower galvanic potential than the remaining critical components of the heat exchanger 100 that causes the sacrificial component to corrode earlier and thus prevent corrosion of other critical components of the heat exchanger 100. With such configuration of the heat exchanger 100, particularly, the heat exchanger 100 with sacrificial component, the corrosion and damage to the critical heat exchange components such as the heat exchange tubes is prevented, thereby preventing leakage and problems caused by the leakage of the heat exchange fluid. The sacrificial component also covers the critical elements of the heat exchanger 100 to protect the same from corrosion and other harsh environment conditions.

The sacrificial component is either part of the housing 130 or attached to the housing 130. In case the housing 130 of the heat exchanger 100 includes side plates, the sacrificial components are attached to the side plates. In case the housing 130 does not include the side plates and the terminal heat exchanger elements 120 act as the side plates, the sacrificial components are directly attached to at least one of the terminal heat exchange elements 120. In one embodiment of the present invention, the heat exchange elements 120 are flat tubes and at least one sacrificial component 140*a*, 140*b* is disposed parallel to and in contact with the flat surface of at least one terminal heat exchange element 120 of the bundle.

The heat exchanger 100 further includes arrangement for securely attaching the sacrificial component to the housing 130 of the heat exchanger 100. Referring to FIG. 6 of the accompanying drawings, the at least one of the first and the second manifolds 110*a* and 110*b* includes a collar 111*a*, 111*b* at least partially overlapping the bundle of heat exchange elements 120 in assembled configuration of the heat exchanger 100. The sacrificial component 140*a*, 140*b* is fixed between the bundle of heat exchange elements 120 and the collar 111*a*, 111*b*. Preferably the sacrificial component 140*a*, 140*b* is in the form of the plate of rectangular configuration as illustrated in FIG. 5.

In accordance with one embodiment, the heat exchanger 100 includes two sacrificial components, particularly two plates, a first plate 140*a* also referred to as first auxiliary plate and a second plate 140*b* also referred to as the second auxiliary plate disposed at opposite sides of the heat exchanger 100. More specifically, the first plate 140*a* and the second plate 140*b* cover the respective terminal flat tubes of the bundle of heat exchange tubes 120 or the first plate 140*a* and the second plate 140*b* cover the side plates, if the housing 130 includes the side plates. In the forthcoming description, configuration of one of the two plates, particularly, the first plate 140*a* is described in details. As the second plate 140*b* acting as the sacrificial component is structurally and functionally similar to the first plate 140*a*, for the sake of brevity of the present document, the second plate 140*b* is not described in details. In accordance with another embodiment of the present invention, at least one of the top plate 130*a* and the bottom plate 130*b* is the sacrificial component. In accordance with still another embodiment of the present invention, at least one of the side plates of the housing 130 is the sacrificial component.

Referring to FIG. 5 of the accompanying drawings, the sacrificial component in the form of the plate includes at least one recessed section 145*a* extending from a median section of the shorter side thereof. The first plate 140*a* includes at least a pair of projections 146*a* located on opposite ends of the shorter side thereof, wherein at least one of the projections 146*a* includes a sloping portion 147*a* configured to facilitate fixing the first plate 140*a* between the bundle of heat exchange elements 120 and the collar 111*a*, 111*b*. In one embodiment, each of the projections 146*a* include the sloping portion 147*a* at extreme end thereof. However, the present invention is not limited to any particular configuration, any particular shape of the first plate 140*a*, the projections 146*a* formed on the plate 140*a* and the sloping portions 147*a* formed on the projections 146*a*, as far as the sacrificial component is capable of being attached to either to the side plates or the terminal flat tubes in case housing 130 does not include the side plates. Further, the present invention is not limited to any particular method of attaching the first plate 140*a* to either the side plate or terminal flat tube in case the terminal flat tube acts as the side plate. The first plate 140*a* can be brazed either to the side plates incase the heat exchanger includes the side plates or to the terminal flat tubes in case the heat exchanger does not include the side plates and the terminal flat tubes acts as the side plates.

The first plate 140*a* includes at least one opening 142*a*. In case the housing 130 does not include side plates and the terminal heat exchange element 120 acts as the side plates, the openings 142*a* on the first plate 140*a*, partially uncovers the surface of the at least one terminal heat exchange elements 120. In case the heat exchanger 100 includes at least one side plate, the sacrificial component is attached to and disposed overlapping the side plate to partially uncovers the surface of the side plate.

In accordance with an embodiment of the present invention, the first plate 140*a* acting as the sacrificial component includes four openings 142*a*. With such configuration of the plate with openings, the weight reduction is achieved. The openings 142*a* are located symmetrically with respect to axis of symmetry of the first plate 140*a*. More specifically, the openings 142*a* are disposed on opposite sides of a first bar 143*a* and a second bar 144*a*, wherein the first and the second bars are median bars 143*a*, 144*a* that intersect each other perpendicularly in the middle of the first plate 140*a* as illustrated in FIG. 5. In accordance with yet another embodiment of the present invention, the first and second bars 143*a* and 144*a* are at an angle with respect to each other. In accordance with an embodiment of the present invention, the total area of the openings 142*a* is greater than the surface area of the remaining surface of the first plate 140*a*. In accordance with another embodiment, the total area of the openings 142*a* is less than the surface area of the remaining surface of the first plate 140*a*. In accordance with yet another embodiment, the total area of the openings 142*a* is equal to the surface area of the remaining surface of the first plate 140*a*. More specifically, the present invention is not limited to any particular configuration of the bars 143*a* and 144*a*, orientation of the bars 143*a* and 144*a* with respect to each other and number, placement and pattern of the openings 142*a* formed on the first plate 140*a*, as far as the openings 142*a* partially uncovers the surface of the terminal heat exchange element 120 or the side plate based on whether the first plate 140*a* is attached to the terminal heat exchange element 120 or the side plate.

Generally, the sacrificial component, at least one plate 130*a*, 130*b*, 140*a*, 140*b* is of Al—Zn alloy. Specifically, the proportion of zinc in the Al—Zn alloy is in the range of 1 to 2 percent. More specifically, the proportion of zinc in the Al—Zn alloy is 1.5 percent.

What is claimed is:

1. A heat exchanger for exchanging heat between a first fluid and a second fluid, the heat exchanger comprising:

a first manifold and a second manifold, a bundle of heat exchange elements for the first fluid axially extending and providing a fluidal communication between the first and second manifolds, a housing for the second fluid encapsulating at least part of the heat exchange elements to form a fluid tight channel for the second fluid, wherein the housing includes at least one sacrificial component being of material having lower galvanic potential than the remaining components, the sacrificial component being a plate that includes at least one opening;

wherein the sacrificial component includes at least one recessed section extending from a median section of the shorter side thereof and at least a pair of projections located on opposite ends of the shorter side thereof, on each side of the at least one recessed section.

2. The heat exchanger according to claim 1, wherein the at least one sacrificial component is part of the housing.

3. The heat exchanger according to claim 1, wherein the at least one sacrificial component is attached to the housing.

4. The heat exchanger according to claim 1, wherein the at least one sacrificial component is attached directly to at least one heat exchange element of the bundle of heat exchange elements.

5. The heat exchanger according to claim 4, wherein the heat exchange elements are flat tubes and the at least one sacrificial component is parallel to and in contact with the flat surface of at least one terminal heat exchange element of the bundle of heat exchange elements.

6. The heat exchanger according to claim 1, wherein at least one of the manifolds includes a collar at least partially overlapping the bundle of heat exchange elements in assembled configuration of the heat exchanger.

7. The heat exchanger according to claim 6, wherein the at least one sacrificial component is fixed between the bundle of heat exchange elements and the collar.

8. The heat exchanger according to claim 4, wherein the at least one sacrificial component is the plate that includes at least one opening, so that it partially uncovers the surface of at least one heat exchange elements.

9. The heat exchanger according to claim 4, wherein the at least one sacrificial component is a plate that includes four openings, so that it partially uncovers the surface of at least one heat exchange elements, wherein the four openings are located symmetrically with respect to axis of symmetry of the plate, so that a first median bar and a second median bar are created, wherein the median bars intersect each other perpendicularly in the middle of the plate.

10. The heat exchanger according to claim 1, wherein the housing is at least partially formed by housing plates, wherein at least one of the housing plates is of Al—Zn alloy.

11. The heat exchanger as claimed in claim 10, wherein the proportion of zinc in the Al—Zn alloy is in the range of 1 to 2 percent.

12. The heat exchanger as claimed in claim 11, wherein the proportion of zinc in the Al—Zn alloy is 1.5 percent.

* * * * *